US006087768A

United States Patent [19]

Beirens

[11] Patent Number: 6,087,768

[45] Date of Patent: Jul. 11, 2000

[54] CATHODE RAY TUBE HAVING A DEFLECTION UNIT WITH PLAY

[75] Inventor: Leopold C. M. Beirens, Eindhoven, Netherlands

[73] Assignee: U.S. Philips Corporation, New York, N.Y.

[21] Appl. No.: 09/103,455

[22] Filed: Jun. 24, 1998

[30] Foreign Application Priority Data

Jul. 9, 1997 [EP] European Pat. Off. ..... 97202131

[51] Int. Cl.[7] ..... H01J 29/76

[52] U.S. Cl. ..... 313/442; 335/212; 348/831

[58] Field of Search ..... 313/440, 442, 313/430, 431; 335/212, 298; 348/831

[56] References Cited

U.S. PATENT DOCUMENTS

| | | | |
|---|---|---|---|
| 4,095,260 | 6/1978 | Suzuki | 348/831 |
| 4,130,836 | 12/1978 | Kornaker | 335/212 |
| 4,730,145 | 3/1988 | van der Meer et al. | 313/440 |
| 5,017,900 | 5/1991 | Ura et al. | 313/440 |
| 5,465,026 | 11/1995 | Roussel et al. | 313/440 |
| 5,770,932 | 6/1998 | Nakane | 313/431 |
| 5,945,779 | 8/1999 | Inoue et al. | 313/440 |

FOREIGN PATENT DOCUMENTS

| | | | |
|---|---|---|---|
| 0 210 699 | 4/1987 | European Pat. Off. | H01J 29/76 |

*Primary Examiner*—Michael H. Day
*Attorney, Agent, or Firm*—Robert J. Kraus

[57] ABSTRACT

A cathode ray tube having a deflection unit, the play between the deflection unit (11) and the envelope (4) being different for two perpendicular (x and y) directions. This enables the tilt of the deflection unit relative to the envelope to be greater in a direction than in a direction at right angles to said direction. By virtue thereof, the distance between the deflection unit and the electron beams can be reduced, so that the deflection requires less energy and can be improved.

4 Claims, 4 Drawing Sheets

CATHODE RAY TUBE HAVING A DEFLECTION UNIT WITH PLAY

BACKGROUND OF THE INVENTION

The invention relates to a cathode ray tube comprising an evacuated tube which includes a neck, a display window and a cone portion, said cathode ray tube being provided with a means for generating at least one electron beam and a deflection unit with a front side facing the display window and having deflection coils for deflecting the electron beam across the display window.

Such cathode ray tubes are used, inter alia, for television receivers and computer monitors.

Cathode ray tubes of the type mentioned in the opening paragraph are known.

In operation, a deflection unit consumes energy.

SUMMARY OF THE INVENTION

It is an object of the invention to provide a cathode ray tube which enables the average energy consumption to be reduced.

To achieve this, a cathode ray tube in accordance with the invention is characterized in that the play between the deflection unit and the envelope at the location of the front side of the deflection unit, measured in a plane (z) extending transversely to the tube axis, is different for two mutually perpendicular directions.

In the manufacture of the cathode ray tube, the deflection unit is placed on a part of the cone portion. In known cathode ray tubes, the inside contour of the deflection unit and the corresponding outside contour of the envelope are substantially similar in shape. If, for example, the outside contour of the envelope is conical with, in each plane transverse to the tube axis, a circular section, then the inside contour of a deflection unit in accordance with the state of the art is also conical with a circular section in each plane. There is some play between the deflection unit and the part of the envelope which it surrounds, so that the deflection unit can be tilted relative to the envelope. By virtue thereof, errors in the image can be reduced. The play is a function of the sum of the distances (d1+d2) between the inside contour of the deflection unit and the outside contour of the envelope. The sum of the distances (for example left+right, or bottom+top) is the same everywhere in the known cathode ray tubes. Or, in other words, the play between the deflection unit and the envelope is the same throughout the circumference. In general, the play is largest at the location of the front side of the deflection unit.

The play between the inside contour of the deflection unit and the outside contour of the envelope enables the deflection unit to be tilted slightly relative to the tube axis. This takes place during the so-called "matching" of the deflection unit relative to the envelope.

In the cathode ray tube in accordance with the invention, there is a difference in play (and hence in the sums of the distances between the deflection unit and the envelope) for two mutually perpendicular directions. The play in two directions (for example the horizontal and vertical directions) is therefore different and the deflection unit can be tilted more in one direction than in another direction.

The invention is based on the recognition that, in practice, the necessary play between the deflection unit and the envelope is not the same for all directions.

These differences vary from design to design and can be established by means of calculations or empirically. By adapting the play between the deflection unit and the envelope to the necessary play, a design can be made in which, on average, the distance between the deflection unit and the envelope is smaller. By virtue thereof, the deflection coils can, on average, be arranged closer to the electron beam. This means that deflection of the electron beam(s) requires, on average, less energy. In addition, an improvement of the deflection and/or a reduction of the number of rejects can be achieved.

These and other aspects of the invention will be apparent from and elucidated with reference to the embodiments described hereinafter.

BRIEF DESCRIPTION OF THE DRAWING

In the drawing.

The Figures are not drawn to scale. In the Figures, like reference numerals generally refer to like parts.

DESCRIPTION OF THE PREFERRED EMBODIMENT

Figure 1:
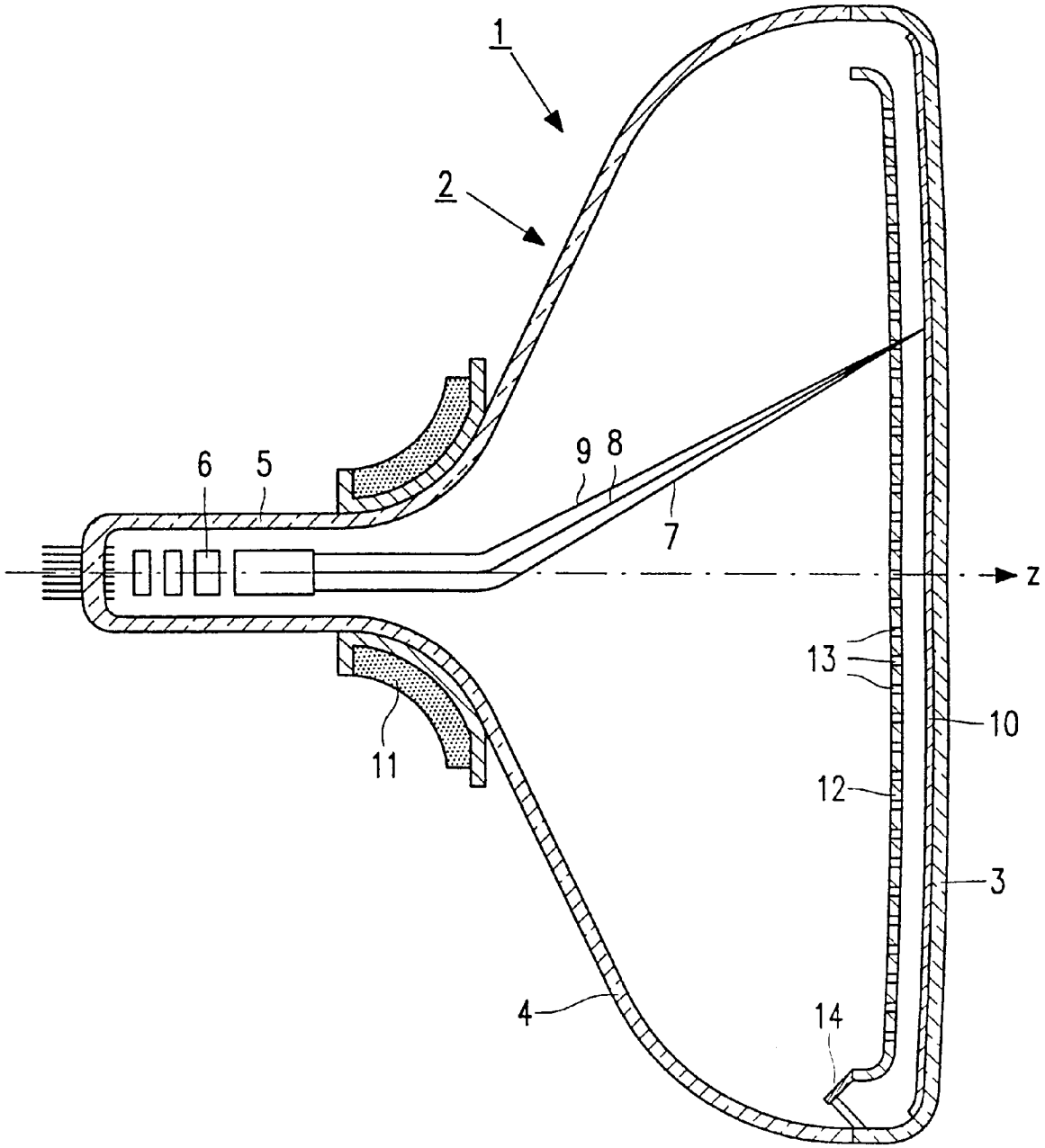
FIG. 1 shows a cathode ray tube.

A color display device 1 (FIG. 1) comprises an evacuated envelope 2 including a display window 3, a cone portion 4 and a neck 5. In the neck 5, there is arranged an electron gun 6 for generating three electron beams 7, 8 and 9. The inner side of the display window is provided with a display screen 10. Said display screen 10 comprises a phosphor pattern of phosphor elements luminescing in red, green and blue. On their way to the display screen, the electron beams 7, 8 and 9 are deflected across the display screen 10 by means of a deflection unit 11 and pass through a shadow mask 12 arranged in front of the display window 3, which shadow mask comprises a thin plate having apertures 13. The shadow mask is suspended in the display window by means of suspension means 14. The three electron beams converge and pass through the apertures of the shadow mask at a small angle with respect to each other, and consequently, each electron beam impinges only on phosphor elements of one color.

Figure 2:
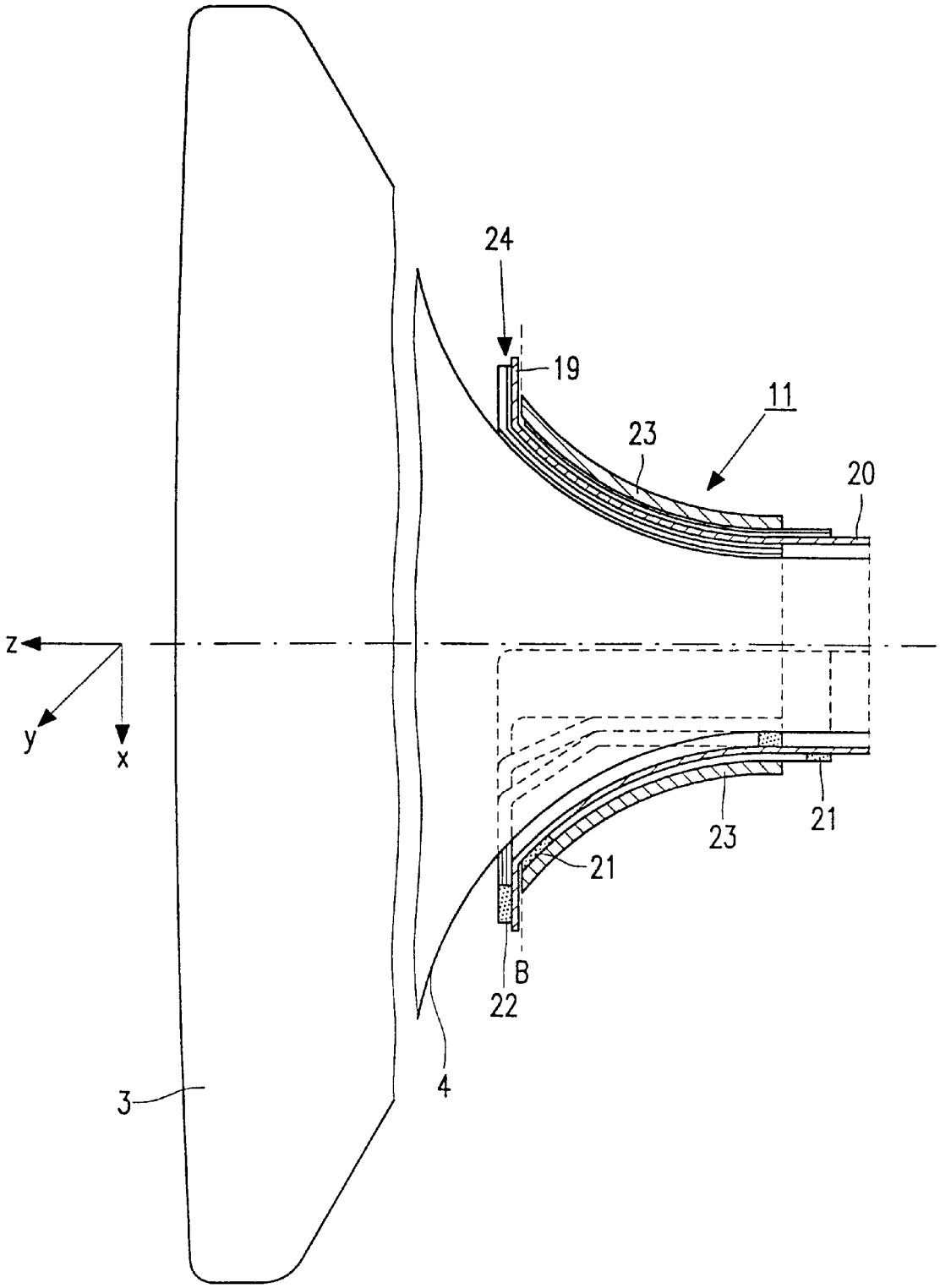
FIG. 2 is a sectional view of a deflection unit.

FIG. 2 is a sectional view of a deflection unit in accordance with the invention. Said deflection unit comprises two deflection coil systems 21 and 22 for deflecting the electron beams in two mutually perpendicular directions (indicated in the Figure by the x and y directions, the tube axis is indicated in the Figure by the z axis). In this example, the deflection unit further comprises a yoke ring 23. Said yoke ring is made of a soft-magnetic material. The deflection unit comprises a front side 24 facing the display window. The deflection coil systems 21 and 22 are situated, respectively, on the inside and outside of a coil support 20 which is provided with a flange 19 at the front side of the deflection unit facing the display window.

Figure 3A:
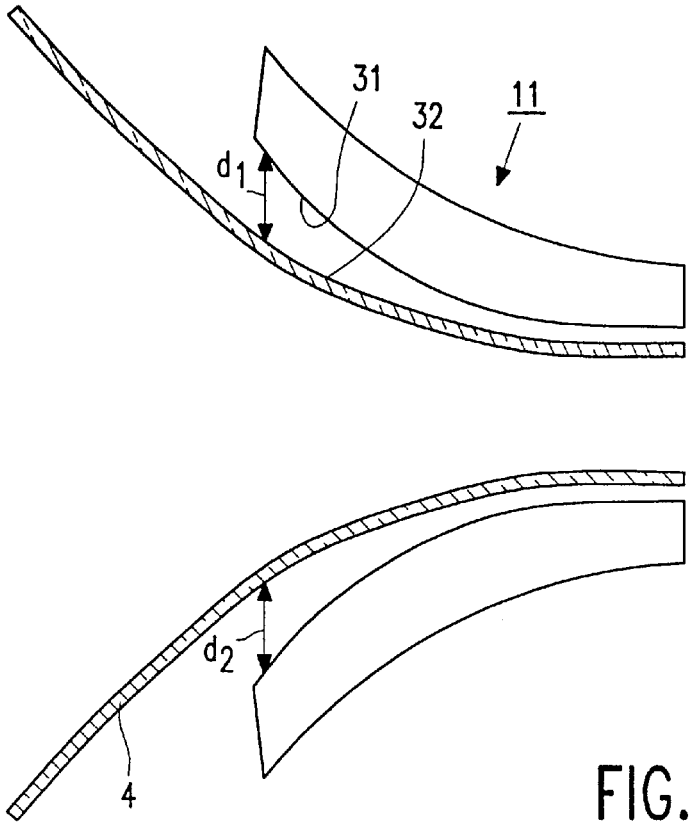
FIGS. 3A and 3B are sectional views of a cathode ray tube provided with a deflection unit, FIG. 4 graphically shows the distances from the inside contour and the outside contour to the tube axis.
Figure 3B:
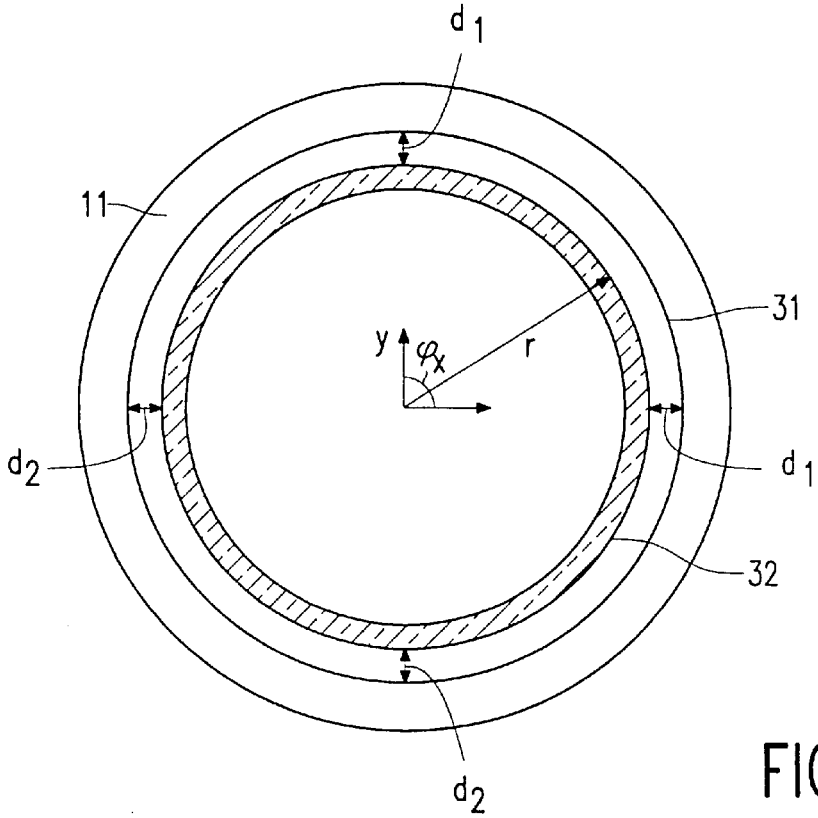

FIGS. 3A and 3B are schematic, sectional views, respectively, in the X-Z plane and X-Y plane along plane B (see FIG. 2), of the relative positions of the deflection unit and the envelope. For clarity, the play (indicated by d1 and d2) between the inside contour 31 of the deflection unit and the outside contour 32 of the envelope is shown on an enlarged scale in these Figures.

During the manufacture of the cathode ray tube, the deflection unit 11 is arranged, with some play, around the envelope approximately at the location of the transition between the neck of the envelope and the cone. In order to optimally adjust the deflection unit, there is customarily some freedom as to the orientation of the deflection unit. The image can be improved by tilting the deflection unit or moving it in the horizontal and vertical directions. This may be necessary, for example, if the axis of the electron gun is not exactly equal to the axis of the envelope. To enable tilting of the deflection unit, said deflection unit is not exactly contiguous to the outside contour of the envelope, but there is mall interspace, which is indicated by the distances d1, d2. The play allowed by the design is determined by the sum of the distances d1+d2. In known display devices, the play is rotationally symmetrical, i.e. around the envelope the amount of play is substantially the same. If the deflection unit is moved or tilted, the sum of the distances between the inside contour of the deflection unit and the outside contour of the envelope, measured in a plane through the tube axis, remains equal. Such distances will hereinafter also be referred to as "play". Maybe this can be illuminated by means of the following example:

Let us assume that the play around the envelope is 3 mm. The sum of the distances in a plane through the tube axis is 3+3 =6 mm. A tilt of the deflection unit of 1 mm to the right and 1 mm downwards causes the distance on the left-hand side and the top side to be reduced by 1 mm and the distance on the right-hand side and the bottom side to be increased by 1 mm. The sum of the distances in a plane through the tube axis (for example the sum of the distances on the left and on the right, or the sum of the play on the bottom side and top side) still remains 6 mm. The position of a point at the outside (or inside) contour relative to the tube axis can be indicated by a distance r and an angle phi.

Although the play clearly has a positive effect, since it enables the image to be improved by tilting the deflection unit, the inventors have recognized that the play also has a negative effect because it increases the distance between the coils and the electron beams. The larger the distance between the coils and the electron beams the more deflection energy is required and the less accurate the deflection is.

The invention is based on the recognition that, in practice, for a cathode ray tube the necessary tilts and movements of the deflection unit often are not rotationally symmetrical but direction-dependent, i.e. they are greater in a direction (for example the X or Y direction) than in a direction transverse to said direction. If the deflection unit and the envelope are constructed so that the play is the same everywhere, then, in order to preclude failure, the play must be equal to the maximally required play in a specific direction.

Figure 4:
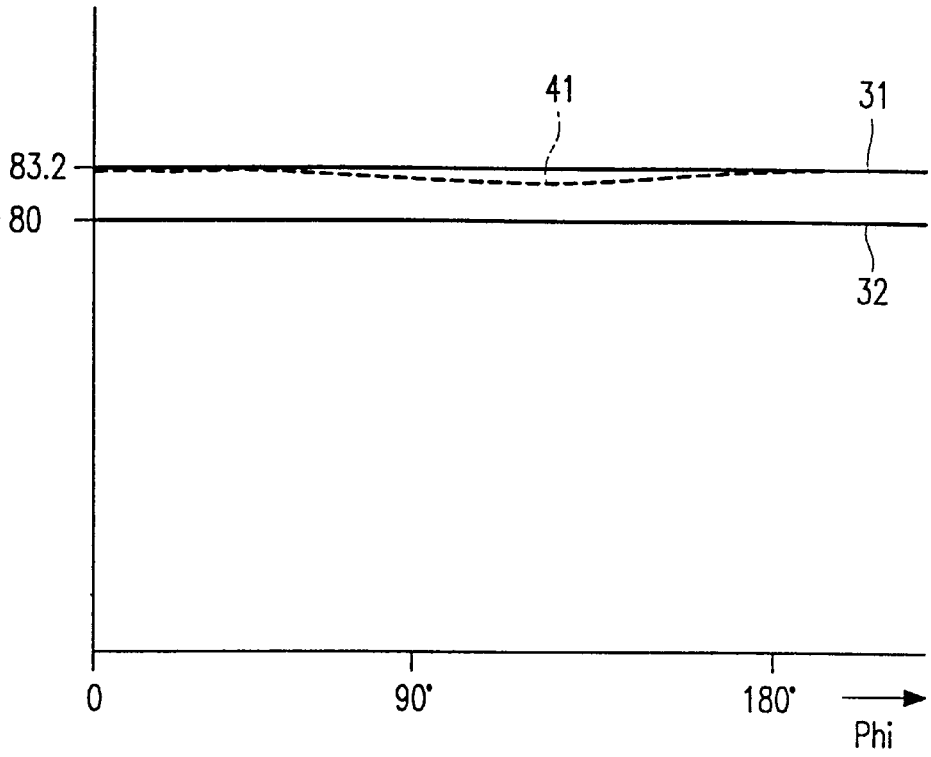

FIG. 4 shows the distances r between the inside contour 32 and the outside contour 31 as a function of the angle phi in a situation in which the play is 3.2 mm and the tube axis coincides with the axis of the deflection unit. Dotted line 41 represents the actually required play (this example relates to an 51 cm NN (Narrow Neck) cathode ray tube with a 90° deflection unit). For the Y direction (phi=90°) the necessary play is only 2.4 mm instead of 3.2 mm, i.e. 0.8 mm less.

By choosing the average distance (half the sum of the distances d1+d2) between the outside contour of the envelope and the inside contour of the deflection unit to be smaller in the Y direction than in the X direction, the distance between the deflection coils and the electron beams is reduced on average (in this case, 0.8 mm in the Y direction) without the possibilities of matching the deflection unit relative to the envelope being reduced in practice.

Figure 5:
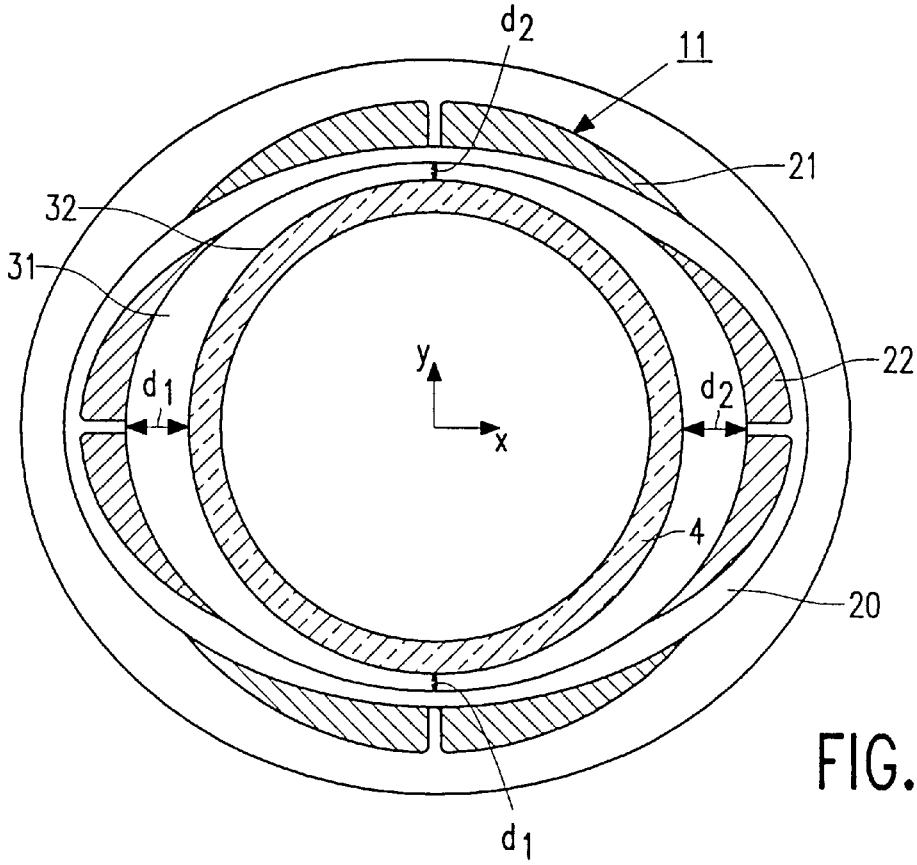
FIG. 5 is a sectional view of a deflection unit and an envelope.

FIG. 5 is a sectional view of the distances d1 and d2 between the deflection unit 11 and the envelope 4. The average play (0.5*(d1+d2)) is larger in the X direction than in the Y direction.

In general, the necessary play and the difference in play is largest at the location of the front side of the deflection unit. In cathode ray tubes, at least at the location of the front side of the deflection unit, the play is different in different planes. Within the scope of the invention, the term "play" should be taken to mean the freedom of tilt between the deflection unit and the envelope, as defined by the design of the deflection unit and the envelope. In an assembled cathode ray tube, the envelope and the deflection unit are rigidly attached to one another, often by applying an adhesive between the deflection unit and the envelope. After application and curing of the adhesive and/or wedges, the deflection unit and the envelope can no longer be moved relative to each other. However, the "play" of the cathode ray tube as described hereinabove is preserved. Whether a cathode ray tube complies or fails to comply with the invention can be established, inter alia, by removing the adhesive and/or wedges, so that the tiltability allowed by the construction of the deflection unit and the envelope is restored, or by measuring the distances d1, d2 in a number of planes and graphically representing these measurements as a function of the angle phi.

Preferably, the difference in play is at least 0.4 mm. Smaller differences yield relatively small advantages.

FIG. 5 also shows an aspect of a preferred embodiment of the invention. At the location of plane B, the holder 20 is oval in shape, with the diameter along the X axis being larger than the diameter along the Y axis, and the difference being approximately equal to the thickness of the deflection coils 22 on the X axis. Within the scope of the invention, "oval in shape" is to be taken to mean any non-round shape having a long axis and a short axis. In this example, the thickness of the coils 22 on the X axis is approximately 3 mm. The diameter of the coil holder along the X axis is 90 mm (diameter of envelope)+2*3.2 mm (play in the X direction)+2*3 mm (thickness of coils 22)=102.4 mm. The diameter of the coil holder along the Y axis is 90 mm+2*2.4 (play in Y direction)=94.8 mm. Relative to a round coil holder, the average distance between coils 21 and the envelope, and hence the distance between coils 21 and the electron beams, is reduced by 7.6/2=3.8 mm. This has the advantage of a reduction in deflection energy. A coil holder with an oval inside contour, with the difference in diameter of the inside surface of the coil holder, measured along the X axis and Y axis, being approximately equal to the thickness of the coils situated on the inside of the coil holder at the location of the X axis, has the additional advantage, in embodiments where the deflection unit is provided with a yoke ring, that a smaller yoke ring can be used. In this example, the inside diameter of the yoke ring is 3.8 mm smaller than in the known deflection unit. As a result, the deflection unit as a whole is smaller and a reduction in yokering material and deflection energy is achieved. The reduction in deflection energy and the smaller distance between the deflection coils and the electron beams also has the advantage that the stray field of the deflection unit is reduced. In general, the play between the deflection unit and the envelope is greatest at the location of the front side (=the side of the deflection unit facing the display screen) of the deflection unit. In other planes there may be a difference in play (for example a plane through the rear side of the deflection unit).

It will be obvious that within the scope of the invention many variations are possible.

What is claimed is:

1. A cathode ray tube comprising an evacuated tube which includes a neck, a display window and a cone portion, said cathode ray tube being provided with a means for generating at least one electron beam and a deflection unit with a front side facing the display window and having deflection coils for deflecting the electron beam across the display window, characterized in that the play between the deflection unit and the envelope at the location of the front side of the deflection unit, measured in a plane extending transversely to the tube axis, is different for two mutually perpendicular directions.

2. A cathode ray tube as claimed in claim 1, characterized in that the difference in play is at least 0.4 mm.

3. A cathode ray tube as claimed in claim 1, characterized in that the two mutually perpendicular directions are the x and y directions.

4. A cathode ray tube as claimed in claim 1, characterized in that the deflection unit comprises a coil holder which is oval in section at least at the location of the front side of the deflection unit.

* * * * *